US008973903B2

(12) United States Patent
Akerstrom

(10) Patent No.: US 8,973,903 B2
(45) Date of Patent: Mar. 10, 2015

(54) BENDABLE POLE FOR WIRE-ROPE SAFETY FENCES

(75) Inventor: Berndt Akerstrom, Ranea (SE)

(73) Assignee: Arjepole Systems AB, Arjeplog (SE)

( * ) Notice: Subject to any disclaimer, the term of this patent is extended or adjusted under 35 U.S.C. 154(b) by 80 days.

(21) Appl. No.: 13/812,652

(22) PCT Filed: Jul. 28, 2011

(86) PCT No.: PCT/SE2011/000141

§ 371 (c)(1),
(2), (4) Date: Feb. 18, 2013

(87) PCT Pub. No.: WO2012/015343

PCT Pub. Date: Feb. 2, 2012

(65) Prior Publication Data

US 2013/0181178 A1 Jul. 18, 2013

(30) Foreign Application Priority Data

Jul. 29, 2010 (SE) ..... 1000803

(51) Int. Cl.
*E01F 15/00* (2006.01)
*E01F 15/06* (2006.01)

(52) U.S. Cl.
CPC ..... *E01F 15/06* (2013.01)
USPC ..... 256/13.1

(58) Field of Classification Search
USPC ..... 256/1, 13.1, 32, 47, 49
See application file for complete search history.

(56) References Cited

U.S. PATENT DOCUMENTS 1,057,260 A * 3/1913 Murray ..... 256/54
6,962,328 B2 * 11/2005 Bergendahl ..... 256/13.1
2005/0269558 A1 * 12/2005 Keefe ..... 256/64

FOREIGN PATENT DOCUMENTS

WO WO 2005040499 A1 * 5/2005 ..... E01F 9/03

* cited by examiner

*Primary Examiner* — Michael P Ferguson
*Assistant Examiner* — Daniel Wiley
(74) *Attorney, Agent, or Firm* — Christensen O'Connor Johnson Kindness PLLC

(57) ABSTRACT

Bendable wire pole (1) intended to fixate the wires in a wire-rope safety fence, comprising at least two curved elongated pole sections (2) connected to each other so that at least an intermediate cavity (4) is formed between the sections (2), whose sections (2) are held together by at least one cohesive body (12). The unique feature of the present bendable wire pole (1) is that it includes at least one intermediate elongated pole section (3) positioned between the curved sections (2), whose sections (2) and (3) in their upper are provided with at least one groove (5) in which wires are designed to be inserted. The pole (1) further comprises at least one spacer unit (6), intended to be connected to the wires and the pole (1), with which the wires are positioned in the vertical and horizontal directions relative to the pole (1).

9 Claims, 3 Drawing Sheets

BENDABLE POLE FOR WIRE-ROPE SAFETY FENCES

FIELD OF THE INVENTION

The present invention concerns a bendable pole for wire-rope safety fences, in accordance with the claims.

TECHNICAL BACKGROUND AND PRIOR ART

Today, wire-rope safety fences, which are usually located between traffic lanes, are used to separate traffic traveling in opposite directions which keeps vehicles from colliding with each other. The wire-rope safety fence prevents oncoming traffic from crossing over into their opposite lanes and thus prevents vehicles from colliding with each other. Wire-rope safety fences are also used as shoulder side wire rope, placed at the road's shoulder to prevent traffic from running of the roadway.

Wire-rope safety fences use poles to hold up and fixate the wire-rope safety fence in relation to the roadway. Today's wire poles have major drawbacks. First, the wire poles have such stability in the vehicle's direction of travel that major injury occurs, especially in connection with the collision of vehicles such as motorcycles. Secondly, existing poles (profile wire beam) include their upper part of grooves which are intended to fix the wires in the horizontal direction which helps to aggravate the injury for a motorcyclist who runs into the wire poles of a wire-rope.

Today's wire-rope is not suitable for collision with motorcycles. In a collision between a motorcyclist and a wire-rope safety fence the motorcyclist usually receive serious bodily harm. It is not uncommon for today's wire poles to cause so great bodily harm that not even a first-aid relief effort will be able to prevent the heavy bleeding caused by a collision with current existing wire poles.

A further problem with existing wire poles is that they also cause great material damage, which means high repair costs. Today's wire poles cause in certain situations such great damage to vehicles such as cars that they must be scrapped and taken out of service, which results in subsequently high costs for individuals and insurance companies.

A yet further problem with existing wire poles is that their construction means that they are largely destroyed (becomes unusable) after a collision and must be replaced with new poles. The consequence of replacing the poles is high material and labor costs. In addition to this there is always great risk of injury for roadwork personnel during these repairs that have to be carried out in traffic, where motorists often do not respect the reduced speed limits.

BRIEF DESCRIPTION OF THE CONCEPT OF THE INVENTION

The main purpose of the present invention is to significantly reduce the above mentioned disadvantages and drawbacks. Another purpose of the present patent application is to provide a device which preferably is more cost effective to install and maintain than previously known designs. These purposes are achieved with the aid of a design in accordance with the claims.

BRIEF DESCRIPTION OF THE DRAWINGS

In the following detailed description of the present invention, reference and references to the following figures will occur. These figures are briefly described in the following figure list. The figures in the exemplified embodiment are not limiting for the scope of protection of the present patent application. Note that the figures are schematic and that certain details thus can be omitted.

DETAILED DESCRIPTION OF THE PREFERRED EMBODIMENTS

Figure 1:
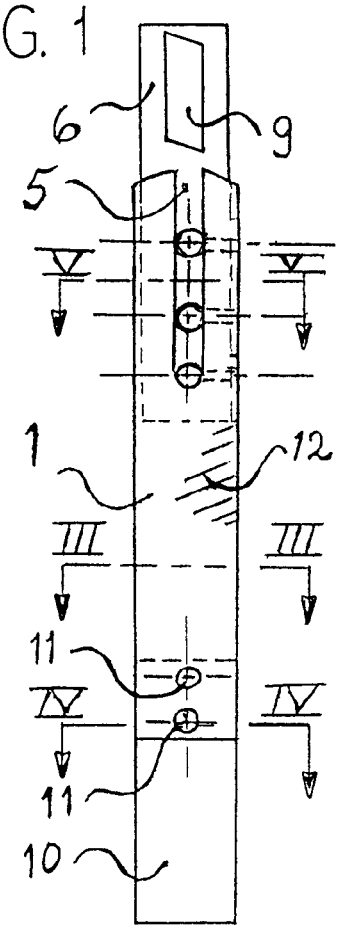
FIG. 1 shows a front view of the first embodiment of the present wire pole.
Figure 2:
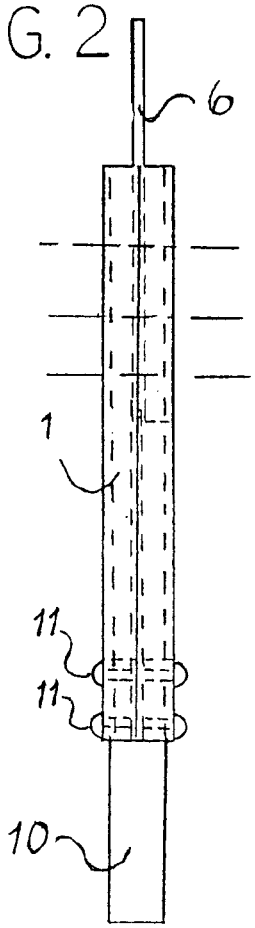
FIG. 2 shows a side view of the first embodiment of the present wire pole.
Figure 3:
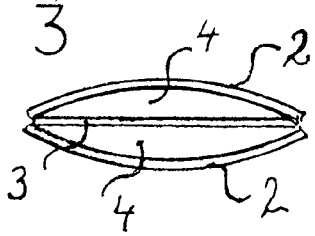
FIG. 3 shows a cross section of the wire pole in accordance with section III of FIG. 1.

Referring to the figures, a bendable wire pole 1 in accordance with the present patent application is shown. The unique feature of the present wire pole 1 is that it is bendable in the direction of travel but at the same time also has good lateral and horizontal stability.

The bendable wire pole 1 includes at least two or more elongated curved-shaped pole sections 2 with at least one intermediate pole section 3. The elongated curved-shaped pole sections 2 form at least one interior cavity (compartment, space) 4

The intermediate pole section 3 is preferably of a flat design. The pole sections 2 and 3 have essentially the same width. The first elongated curved-shaped pole section's 2 and the intermediate pole section's 3 side edges coincide with each other.

All sections 2 and 3 are in their upper part equipped with a groove (slot) 5 in the sections' longitudinal direction in which steel wires are designed to be inserted from above during their assembly. The wires are fixed and positioned in the groove 5 with at least one spacer unit 6. The spacer unit 6 is preferably made of thin spring steel or a material with similar properties. The spacer unit 6 is preferably equipped with a number of holes 7, which corresponds to the number of wires in the wire-rope safety fence. The spacer unit 6 further includes a number of slits (grooves) 8 from the holes 7 to the edge of the spacer unit 6. The spacer unit 6 is preferably equipped with as many slots as the number of holes 7. The slots have a width (dimension), preferably smaller than the diameter of holes, so that the wires are locked and secured in a vertical position on the pole's slot.

During assembly of the pole 1 the cables (wires) are mounted from the top of the groove 5 in the pole 1, then the spacer unit 6 is inserted from the side, between the pole sections 2 and this locks the wires in the vertical position. Alternatively, the spacer unit 6 is attached to the wires before the wires and the spacer unit 6 are inserted from the top of the groove 5. The distance unit 6 is preferably slightly curved and is above the poles upper end preferably equipped with reflective material and also functions as a warning device. The spacer unit 6 is in its upper end extended (has a part which in use is visible above the pole's top end). The extended portion is preferably provided with reflective material 9 on both sides.

Figure 4:
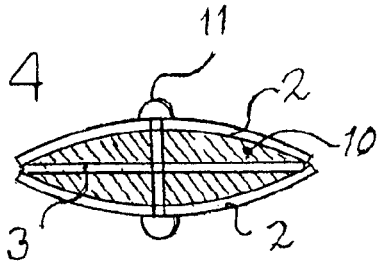
FIG. 4 shows a cross section of the wire pole, with an associated foot section, according to section IV of FIG. 1.
Figure 5:
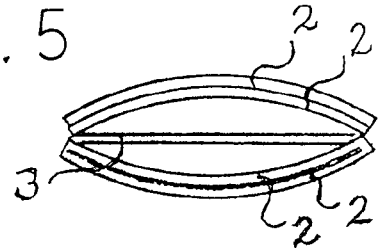
FIG. 5 shows a cross section of an alternative embodiment of the wire pole with several pole sections.
Figure 6:
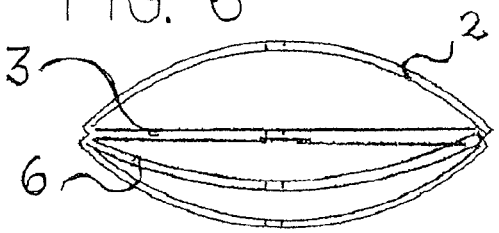
FIG. 6 shows a cross section of the wire pole according to section V of FIG. 1.

Preferably the pole 1 in its lower part includes at least a foot section 10 with which the pole, is intended to be connected to the roadway or the like. Foot section 10 is in its upper part intended to be inserted into a cavity 4 between the pole sections 2 in the bottom of the pole 1. The intermediate section 3 is connected to the foot section through a slit as shown in cross section IV-IV in FIG. 4. Foot section 10 is also a profile which is consistent with the external pole sections' 2 profiles and connects sections 2 and 3. Sections 2 and 3 are mounted in the foot section 10 with through rivets 11 or screws or the like and are then enclosed when needed by an appropriate cohesion body. Foot section 10 may alternatively be of molded plastic or the like formed into the desired shape and join sections 2 and 3 into one unit, thereby simplifying the manufacturing process.

The spacer unit 6 is preferably used as a combined reflective and spacer device that can advantageously be white in its base color or another for the purpose of appropriate color.

Figure 8:
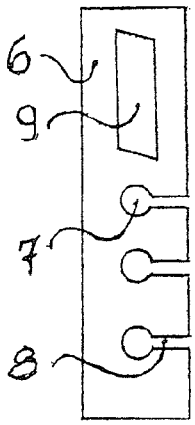
FIG. 8 shows an exemplifying embodiment of a spacer unit in a front elevational view.
Figure 8A:
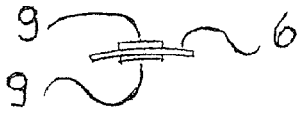
FIG. 8A shows the exemplifying embodiment of a spacer unit in a top view.
Figure 8B:
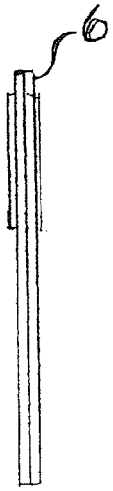
FIG. 8B shows the exemplifying embodiment of a spacer unit in a side elevational view.
Figure 8C:
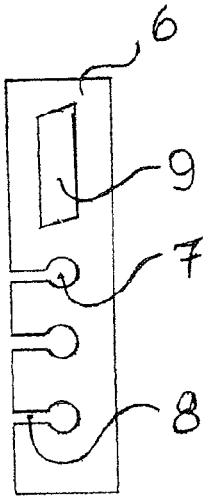
FIG. 8C shows the exemplifying embodiment of a spacer unit in a rear elevational view.

Alternatively, the pole or spacer unit may be enclosed by a cohesion body 12 which is white in color and that reflective materials is then mounted on the outside of the cohesion body, preferably on both sides as shown in FIG. 8.

Figure 7:
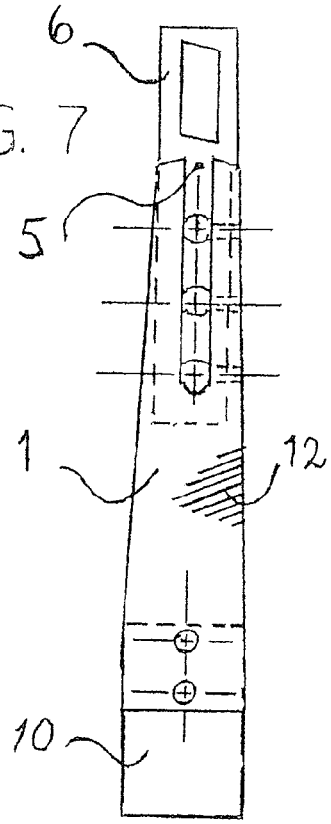
FIG. 7 shows an alternative embodiment of the wire pole where it is wider in its lower part than in its upper part.
Figure 9:
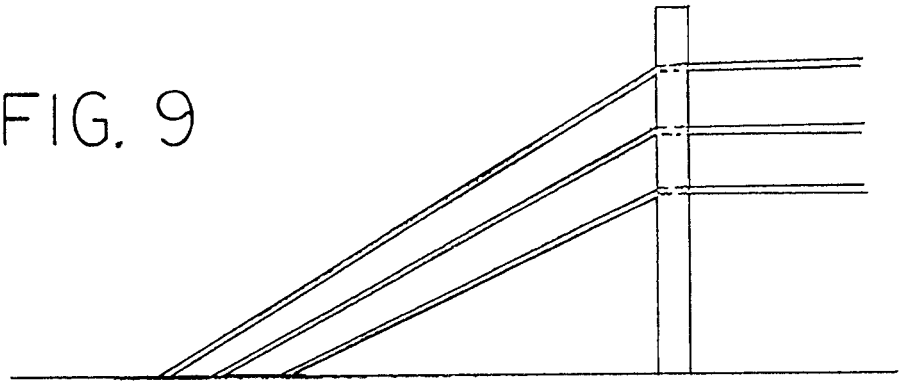
FIG. 9 shows a side view of a wire-rope safety fence.

The first and last pole 1 in a stretch of wire-rope safety fence, such as shown in FIGS. 7 and 9 is exposed to a higher load than the other poles. The higher load is dependent on that the wires are attached to the road surface and are angled up to the pole resulting in a higher load on the first and last post in a stretch of wire-rope. The first pole and the last pole 1 in a length of wire-rope are thus preferably reinforced. This reinforcement could for example be achieved by the pole being designed in a thicker material. Alternatively, the first and last pole can be reinforced by several curved sections the pole's lower part.

In an alternative embodiment, shown in FIG. 7, the pole in its longitudinal direction has a conical (tapered) shape. The conical (tapered) wire pole makes the pole more stable in the lower part, while retaining its flexible features at the top. The tapered pole makes it particularly suitable for use as a warning marker in conjunction with the wire-rope safety fence beginning and ending. Starting and ending a stretch of wire-rope with a conical wire pole also has the advantage that it better withstand the increased forces that occur when the wires goes from the anchor points in the roadway to a higher horizontal position secured in the pole.

Figure 10:
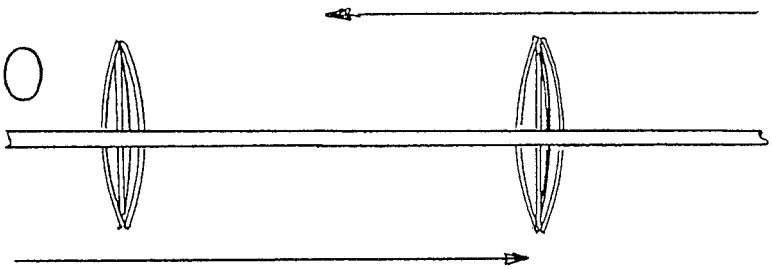
FIG. 10 shows a wire-rope safety fence seen from above.

With reference to FIG. 10 is shown how the wire poles of a wire-rope safety fence can be placed perpendicular in relation to the roadway's direction of travel.

Figure 11:
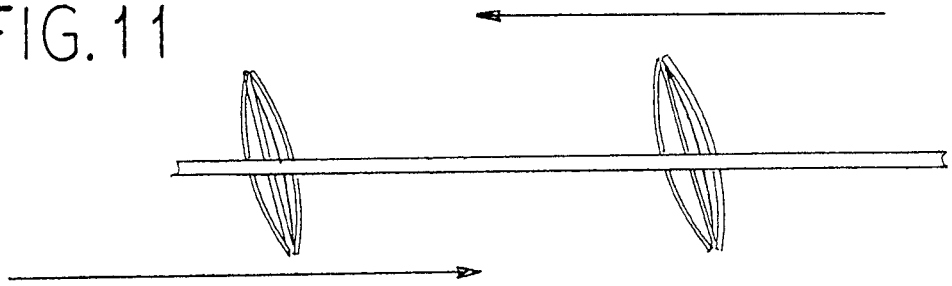
FIG. 11 shows a wire-rope safety fence seen from above.
Figure 12:
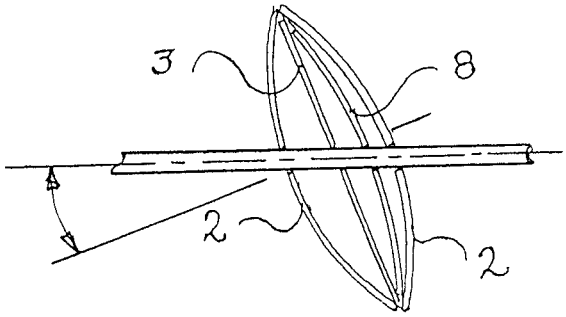
FIG. 12 shows a pole as seen from above, somewhat enlarged and angled.

With reference to FIG. 11 is shown how the poles of a wire-rope safety fence can be placed angled relative to the direction of travel. The angle of the poles leads to further reductions in injuries during collision with the poles.

The pole's lateral stability is reinforced by one or more thin flat sections 3 placed between the curved sections 2. The new wire pole retains by a combination of curved sections and one or more flat sections, a lateral stability that together prevents traffic from crossing over to the oncoming traffic lane.

The new wire pole can be used both as a wire pole in a wire-rope safety fence separating traffic lanes and as wire-rope safety fences at the shoulders (edges) of the road. The design results in a reduced risk of injury for motorcyclists colliding with wire-rope safety fences.

In the detailed description of the present invention, design details may have been omitted which are apparent to persons skilled in the art. Such obvious design details are included to the extent necessary so that the proper and full performance of the present invention is achieved.

Even if certain preferred embodiments have been described in detail, variations and modifications within the scope of the invention can become apparent for specialists in the field and all such are regarded as falling within the scope of the following claims.

Advantages of the Invention

The present invention achieves a number of advantages. First, the pole reduces injuries to a large extent for a motorcyclist that collides with the wire pole. A further advantage of the present wire pole is that it causes less damage to vehicles driving on the pole than previously known designs of wire poles. The present wire pole also has the advantage that it includes fewer parts. For example, the pole includes parts that have multiple functions in a single detail. Furthermore, the need for fasteners such as clamps, spacers, and more is reduced. It is also an advantage of the present wire pole that the same design can be used for both middle and side wire-rope fences. A still further advantage of the present wire pole is that its flexibility will reduce the need for costly and dangerous maintenance work since the poles thanks to their spring-like properties are not susceptible to breaking to the same extent as current designs.

The invention claimed is:

1. A bendable wire pole (1) to fixate wires in a wire-rope safety fence, comprising:

at least two elongated curved pole sections (2), the curved pole sections connected to each other at lateral edges thereof, an intermediate cavity (4) formed between the curved pole sections (2), at least one retaining body (12) holding together the curved pole sections, at least one intermediate elongated pole section (3) positioned between the curved pole sections (2) thereby dividing the intermediate cavity (4) into first and second cavity portions (4) on either side of the intermediate elongated pole section (3), the elongated curved pole sections and the intermediate elongated pole section (3) having upper ends with at least one groove (5) in a longitudinal direction thereof, at least one elongated curved spacer unit (6) having a plurality of holes therethrough; and a plurality of wires inserted in the plurality of holes in the spacer unit;

whereby the spacer unit is inserted into one of the first and second cavity portions, such that the plurality of wires is disposed within the grooves of the elongated curved pole sections and the intermediate elongated pole section.

2. The bendable wire pole (1) in accordance with claim 1 wherein the pole has edges, the edges being in the longitudinal direction, the edges being essentially parallel.

3. The bendable wire pole (1) in accordance with claim 1 wherein the pole (1) has a lower portion and an upper part, the pole (1) being wider in its lower portion than its upper part.

4. The bendable wire pole (1) in accordance with claim 1 wherein the pole sections are made of a resilient material.

5. The bendable wire pole (1) in accordance with claim 1 wherein the retaining body consists of shrink tubing.

6. The bendable wire pole (1) in accordance with claim 1 wherein the bendable wire pole (1) includes at least one foot.

7. The bendable wire pole (1) in accordance with claim 1 wherein the wire pole (1) is essentially perpendicularly positioned relative to the wire's wires longitudinal direction.

8. The bendable wire pole (1) in accordance with claim 1 wherein the wire pole (1) is angled relative to the wires longitudinal direction.

9. The bendable wire pole (1) in accordance with claim 1 wherein the retaining body consists of adhesive tape.

* * * * *